United States Patent [19]

Stewart

[11] Patent Number: 4,706,418

[45] Date of Patent: Nov. 17, 1987

[54] ROOFING CANT

[75] Inventor: Victor M. Stewart, Redmond, Wash.

[73] Assignee: Industrial Research Development, Inc., Kirkland, Wash.

[21] Appl. No.: 900,321

[22] Filed: Aug. 26, 1986

[51] Int. Cl.[4] ..... E04F 17/04; E02B 11/10

[52] U.S. Cl. ..... 52/58; 52/199; 52/303; 52/305; 98/42.01; 405/43

[58] Field of Search ..... 98/42.21, 42.17, 42.22, 98/42.01; 52/198, 199, 95, 305, 303, 58, 169.5; 405/43

[56] References Cited

U.S. PATENT DOCUMENTS

| | | | |
|---|---|---|---|
| 335,577 | 2/1886 | Golde | 52/199 X |
| 412,313 | 10/1889 | Weis et al. | 52/199 X |
| 2,084,351 | 6/1937 | Luce | 405/43 X |
| 2,146,775 | 2/1939 | Stoutenburgh | 52/169.5 |
| 3,017,722 | 1/1962 | Smith | 52/169.5 |
| 3,332,185 | 7/1967 | Adams | 52/303 X |
| 3,665,663 | 5/1972 | Scherer | 52/95 |
| 3,949,657 | 4/1976 | Sells | 52/199 X |
| 3,984,947 | 10/1976 | Patry | 52/1 |
| 4,045,964 | 9/1977 | Barclay | 52/169.5 X |
| 4,134,268 | 1/1979 | Elmore | 405/43 |
| 4,223,486 | 9/1980 | Kelly | 52/199 X |
| 4,484,424 | 11/1984 | Logsdon | 52/199 |
| 4,538,508 | 9/1985 | Ballard | 98/42.17 |

FOREIGN PATENT DOCUMENTS

| | | | |
|---|---|---|---|
| 615327 | 2/1961 | Canada | 52/199 |
| 1103284 | 5/1955 | France | 52/198 |
| 2153067 | 8/1985 | United Kingdom | 98/42.21 |

*Primary Examiner*—Alfred C. Perham

*Attorney, Agent, or Firm*—Berman, Aisenberg & Platt

[57] ABSTRACT

A hollow tubular roofing cant has a plurality of perforations for permitting ingress of moisture or gases from the roofing system and a plurality of one-way vents for permitting egress of moisture or gases into the atmosphere. The tubular roofing cant may be of triangular or trapezoidal cross-section.

14 Claims, 3 Drawing Figures

ROOFING CANT

FIELD OF THE INVENTION

This invention relates to a roofing cant for channeling moisture or gases from a roofing system into the atmosphere.

BACKGROUND OF THE INVENTION

When moisture or gases collect in a roofing system, many problems can occur when the moisture or gases are trapped beneath the waterproof roofing membrane used to seal a roof. Different types of venting means have been used in attempts to find a satisfactory solution to this problem. Roofing vents, including roofing vents having one way valves, have been used in the past. Gases may particularly be found in a roofing system if polyurethane or polyisocyanurate roofing insulation is used.

The patent to Golde (U.S. Pat. No. 335,577) shows a shed construction including vent outlets. Patry (U.S. Pat. No. 3,984,947) describes a roof structure including a one-way vapor vent through which moist air within the structure passes to the ambient surroundings. Kelly (U.S. Pat. No. 4,223,486) describes a roof structure provided with one or more one-way valves, the base of each valve opening into an area between a loosely laid membrane and the roof between the loosely laid membrane and the insulation with the negative air pressure which occurs on the top of the roof when wind blows across the roof. The roof vent of the Logsdon patent (U.S. Pat. No. 4,484,424) is directed to a one-way vent which allows for passage of fluid from between the layers of the roof to the ambient, but does not show a roofing cant. The ventilated device of the Ballard patent (U.S. Pat. No. 4,538,508) allows escape of air from enclosed spaces through an insert which includes a flow control valve, but does not show a roofing cant.

Conventional roofing cants include triangularly cut wood strips, which have the disadvantage of being subject to warping and/or rotting.

SUMMARY OF THE INVENTION

A roofing cant of the invention comprises extruded plastic tubing, preferably of triangular or trapezoidal cross-section, having perforations through which moisture or gases from a roofing system can enter the tubing, the moisture or gases exiting from the tubing through pipe vents or other ventilators, preferably having one-way valves which do not allow moisture or gases to reenter the system. The roofing cant may be placed around the perimeter of a roof, around part of the perimeter, or may be used in a roof peak, or at any other appropriate location.

It is an object of the invention to provide an improved roofing cant, a method for its manufacture, and a method for its use.

It is another object of the invention to provide a roofing cant of triangular or trapezoidal cross-section.

It is yet another object of the invention to provide a roofing cant which is perforated at intervals to allow entry of moisture or gases from the roofing system into the body of the cant.

It is still another object of the invention to provide a roofing cant having venting means for allowing moisture or gases from the roofing system to escape into the ambient atmosphere.

It is a further object of the invention to provide a method of manufacturing a roofing cant.

It is a still further object of the invention to provide a method of using a roofing cant of the invention.

DETAILED DESCRIPTION OF THE INVENTION

The invention is a prefabricated roofing cant, preferably installed in conjunction with waterproof roof flashing, which provides venting of roofing and substrate materials around roof perimeters. The roofing cant of the invention may also be installed at the peak of a roof or at other appropriate locations. The cant unit is a hollow, tubular-shaped extrusion of, for example, polystyrene or acrylonitrile-butadiene-styrene copolymer, having a triangular or trapezoidal cross-section. Other cross-section shapes and materials may be equally suitable, and will be apparent to one skilled in the art. Fire-resistant material, such as acrylonitrile-butadiene-styrene copolymer is particularly suitable for making the cant.

The roofing cant of the invention has unexpected advantages in use, by providing a defined conduit through which moisture or gases in the roofing substrate may leave the roofing system. The perforated slots, through which moisture or gases enter the cant, are large enough not to be subject to blockage. The cant, which is preferably made of plastic, is not subject to rotting or warping. The cant may be either extruded or made by any other appropriate conventional method, and is inexpensive to manufacture, lightweight, easy to install, and maintenance-free in use.

Figure 1:
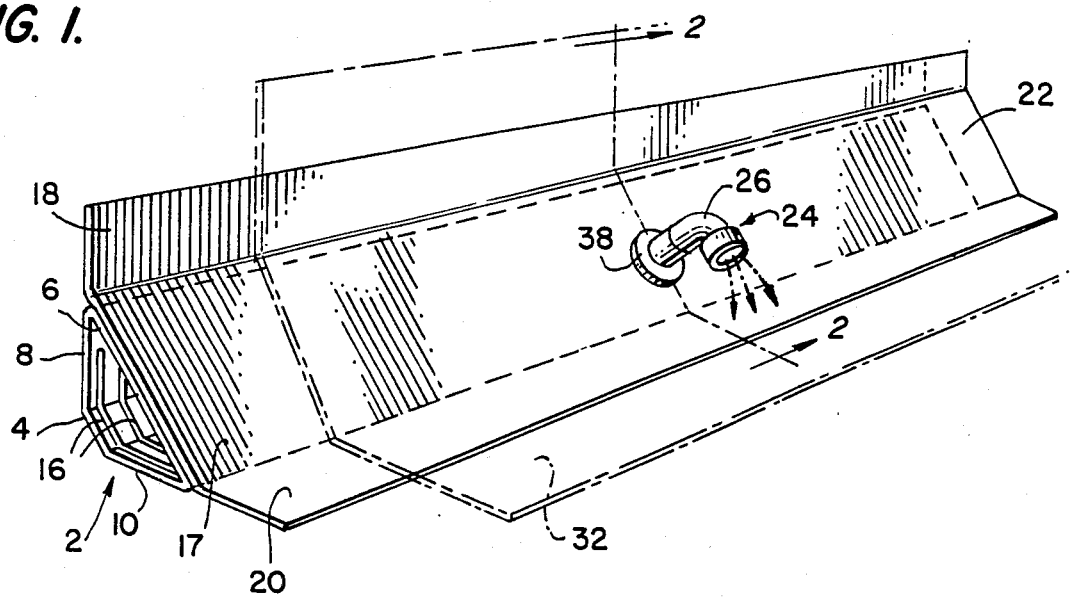
FIG. 1 is a perspective view of a roofing cant of the invention, as installed on the perimeter of a roof.
Figure 2:
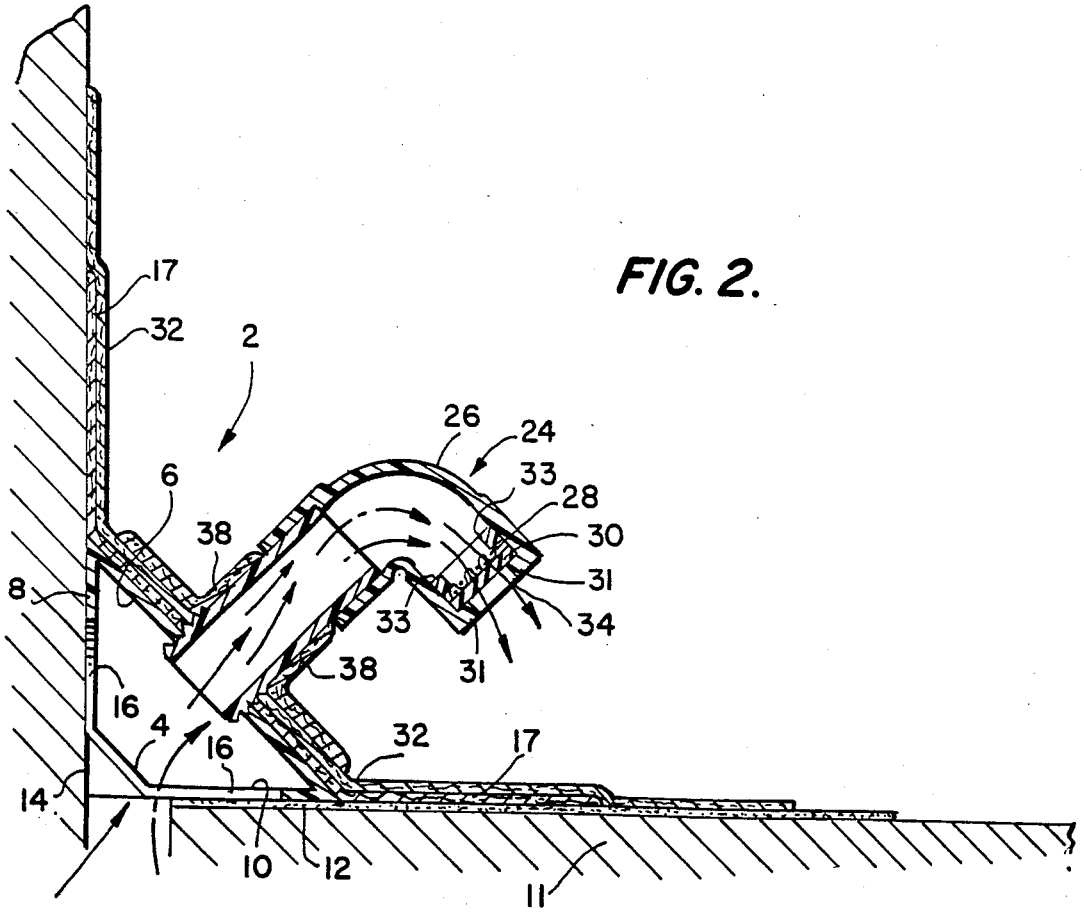
FIG. 2 is a cross-section taken on plane 2—2 of FIG. 1.
Figure 3:
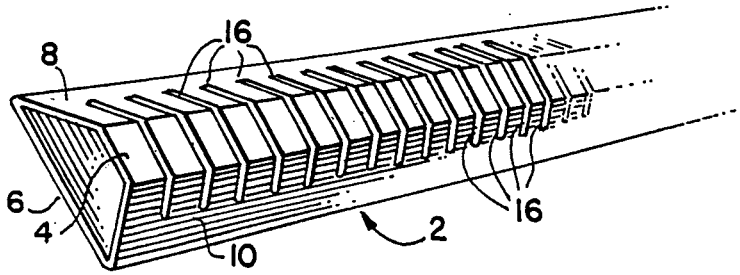
FIG. 3 is a perspective view of a section of a roofing cant of the invention, upturned to show typical perforations.

Referring now to FIGS. 1 to 3 in which like numerals represent similar parts, roofing cant 2 has a hollow, trapezoidal, tubular, extruded body having parallel sides 4, 6 connected by sides 8, 10. Roofing cant 2 is appropriately installed, for example, at the perimeter of the roof 11 against a sidewall or parapet 14. Roofing cant 2 allows ingress of moisture or gases from the roofing substrate 11 and base sheet 12 through perforated slots 16. Slots 16 may be formed as individual perforations or slots in sides 4, 8 and/or 10, or a perforation may be continuous from side 8 through side 4 into side 10, as shown by perforations 16 in FIG. 3. Other configurations of slots may be equally useful.

A threaded $\frac{3}{4}$ in. diameter PVC pipe 24 with a 90° elbow 26 containing a wire mesh screen insert 28 and a one-way rubber valve 30, known in the art, is provided as a vent for each 8 ft. section of cant to allow egress of moisture or gases to the atmosphere. Valve 30 and screen 28 are optionally held between two plastic rings 31 and 33 which are adhesively sealed to pipe 24 or held by other approximate means. Valve 30 and screen 28 may be situated where shown on FIG. 2, or may be situated close to outlet 34 of pipe 24. Other designs and sizes of vent may be equally suitable.

The roofing cant is, for example, conveniently cut into 8 ft. lengths, having perforations 3/32 in. wide by 2 in. long, cut at 3 in. centers through each length. A 10 in. wide by 8 ft. 4 in. strip of modified bitumen roofing membrane, or other roofing membrane 17, is applied by the use of heat and pressure to face 6, which is approximately 4 in. wide, of an 8 ft. length of roofing cant. An overhang, of 3 in. on each side of the cant, forms sidelaps 18, 20, and a 4 in. overhang on one end forms headlap 22. When the cant unit having roofing membrane 17 attached, has been laid in place, the headlap and sidelaps are sealed, roofing membrane 32 is adhesively mopped into place covering membrane 17, a $\frac{3}{4}$ in. diameter hole is drilled through membranes 32 and 17 and through cant face 6, and vent pipe 24 is screwed in place. Caulk 38 securely seals around vent pipe 24.

The installed roofing cant unit allows moisture or gases in a roofing system to travel to vent slots 16, pass into cant 2, and then escape to the ambient atmosphere through one-way valve 30 in vent pipe 24.

Other widths, lengths, and spacings of the perforated vent slots will be apparent to one skilled in the art. Variations in the installation system are within the scope of the invention. After bitumen roofing membrane 17 has been sealed to the roof, a modified bitumen cap flashing or membrane 32 is preferably applied to further seal the cant unit to the roof. Bitumen cap flashing 32 seals the PVC vent pipe 24 to roofing membrane 17 and to optional roof base sheet 12. Roofing base sheet 12 may be either a vented (perforated) base sheet, or may be a solid base sheet nailed or fastened with fasteners to roofing substrate 11. In use, roofing membrane 17 is preferably applied to cant 2 at the factory, though it may alternatively be field applied. Roofing membrane 17 is torched, adhered or mopped to roofing base sheet 12 and to the parapet or sidewall 14 to form a base flashing and to fix the cant unit in place. When the cant unit is in place, cap flashing 32 is applied, PVC vent pipe 24 is screwed into a hole drilled through the face of the flashing and cant, and the pipe perimeter is caulked with caulk 38. Other installation methods may be used, including the use of adhesives and fasteners. The roofing cant system of the invention may be used with various types of roofing material, which is generally applied after the cant system is in place.

The roofing membrane may be applied to the cant in the factory, before installation, as described, or the cant may be installed on the roof, and then the roofing membrane added. It is particularly advantageous to adhere membrane 17 to cant 2 in the factory.

In installation on the peak of a roof, or where two opposite slopes meet, two roofing cants may be placed back to back at the peak. Other cross-sections of roofing cant may be particularly appropriate for peak installation, or for particular roof configurations.

While the invention has been described with respect to certain embodiments thereof, it will be appreciated that various changes and modifications may be made without departing from the spirt and scope of the invention.

What is claimed is:

1. A roofing cant comprising tube means having a substantially trapezoidal cross-section for channeling moisture or gases, perforation means for ingress of moisture or gases to the tube means, and venting means for egress of moisture or gases from the tube means.

2. A roofing cant of claim 1 wherein the perforation means is located in at least one of the sides of the cant.

3. A roofing cant of claim 2 wherein the perforation means is located in at least one of the non-parallel sides of the cant.

4. A roofing cant of claim 2 wherein the perforation means is located on the shorter of the two parallel sides of the cant.

5. A roofing cant of claim 2 wherein the perforation means is located in at least one of the non-parallel sides and in the shorter parallel side of the cant.

6. A roofing cant of claim 5 wherein the perforation means comprises at least one continuous slot, said slot having a first end portion in a first non-parallel side and a second end portion in a second non-parallel side and a bight portion in the shorter parallel side of the cant.

7. A roofing cant of claim 1 wherein the tube means is perforated at intervals by the venting means.

8. A roofing cant of claim 7 wherein the venting means is located in the longer parallel side of the cant.

9. A roofing cant of claim 8 wherein the venting means comprises one-way valve means for preventing re-entry of moisture or gases into the tube means.

10. A roofing cant of claim 1 wherein the tube means is made from plastic material.

11. A roofing cant of claim 10 wherein the plastic material is polystyrene or acrylonitrile-butadiene-styrene copolymer.

12. A roofing cant comprising tube means for channeling moisture or gases, perforation means for ingress of moisture or gases to the tube means, venting means for egress of moisture or gases from the tube means, and flexible, impervious sheet means attached to an outer surface of the tubing means, extending outwardly therefrom for securing the cant to a roofing surface.

13. A roofing cant of claim 12 wherein the flexible sheet means comprises bitumenized roofing membrane.

14. A roofing cant of claim 12 wherein the flexible sheet means extends outwardly forming sidelaps and a headlap.

* * * * *